US008450896B2

(12) United States Patent
Weber

(10) Patent No.: US 8,450,896 B2
(45) Date of Patent: May 28, 2013

(54) ACTUATOR

(75) Inventor: Thomas Weber, Winterbach (DE)

(73) Assignee: Mahle International GmbH (DE)

( * ) Notice: Subject to any disclaimer, the term of this patent is extended or adjusted under 35 U.S.C. 154(b) by 305 days.

(21) Appl. No.: 13/001,196

(22) PCT Filed: Jun. 9, 2009

(86) PCT No.: PCT/EP2009/057086
§ 371 (c)(1),
(2), (4) Date: Dec. 23, 2010

(87) PCT Pub. No.: WO2009/156268
PCT Pub. Date: Dec. 30, 2009

(65) Prior Publication Data

US 2011/0101809 A1 May 5, 2011

(30) Foreign Application Priority Data

Jun. 24, 2008 (DE) ..... 10 2008 030 003

(51) Int. Cl.
*H02K 5/22* (2006.01)

(52) U.S. Cl.
USPC ..... 310/91; 310/89

(58) Field of Classification Search
USPC ..... 310/89, 91
IPC ..... F02D 9/10
See application file for complete search history.

(56) References Cited

U.S. PATENT DOCUMENTS

| | | | | |
|---|---|---|---|---|
| 2,230,581 | A | 10/1938 | Avigdor | |
| 6,763,582 | B2 * | 7/2004 | Kaiser et al. | 29/854 |
| 7,078,835 | B2 * | 7/2006 | Gross et al. | 310/89 |
| 7,207,545 | B2 * | 4/2007 | Kawai et al. | 251/129.11 |
| 2001/0026107 | A1 * | 10/2001 | Uruma et al. | 310/91 |
| 2003/0117030 | A1 * | 6/2003 | Agnes et al. | 310/89 |
| 2004/0119041 | A1 | 6/2004 | Kawai et al. | |
| 2004/0123838 | A1 | 7/2004 | Hashimoto et al. | |
| 2006/0181167 | A1 * | 8/2006 | Bradfield et al. | 310/89 |

FOREIGN PATENT DOCUMENTS

| | | |
|---|---|---|
| DE | 3332036 | 3/1984 |
| DE | 10351382 A1 | 5/2004 |
| EP | 1281849 A2 | 2/2003 |
| EP | 1777150 A2 | 4/2007 |

OTHER PUBLICATIONS

Germany Search Report for DE 102008030003.9 dated Jan. 16, 2013.
English abstract for DE-3332036.

* cited by examiner

*Primary Examiner* — Tran Nguyen
*Assistant Examiner* — Naishadh Desai
(74) *Attorney, Agent, or Firm* — Rader, Fishman & Grauer PLLC

(57) ABSTRACT

An actuator that includes a housing and an electric motor arranged in the housing. The housing has an insertion opening with a cylindrical motor receiving compartment through which the electric motor is axially inserted. The electric motor axially rests on a bottom of the motor receiving compartment on a first side and axially projects from the insertion opening on an opposite side. The electric motor rests axially on a cover that is screwed to the housing for closing the insertion opening. The housing is at least partially threaded in an axial insertion section of the insertion opening. The cover has a threaded section complementary to the thread of the housing. The cover has a cup-shaped section with a cylindrical wall and a bottom on which the electric motor rests axially.

20 Claims, 11 Drawing Sheets

ACTUATOR

CROSS-REFERENCES TO RELATED APPLICATIONS

This application claims priority to German application DE 10 2008 030 003.9 filed on Jun. 24, 2008, and PCT EP/2009/057086 filed on Jun. 9, 2009, both of which are hereby incorporated by reference in their entirety.

TECHNICAL FIELD

The present invention relates to an actuator, in particular an adjusting element for a vehicle.

BACKGROUND

Adjusting elements of this kind can be used in vehicles, for example, as flap actuator device wherein at least one actuating member is a flap by means of which a cross-section through which a flow can pass of a gas-conveying line can be controlled. Such a flap actuator device can be used, for example, in a fresh gas duct or in an exhaust gas duct of an internal combustion engine or in a fuel cell of the vehicle. Also known are adjusting elements for adjusting a guide vane geometry of a turbine of an exhaust gas turbocharger. Furthermore, a so-called "wastegate" of a turbocharger can be actuated by means of such an adjusting element.

SUMMARY

The present invention is concerned with the problem to provide, for an actuator of the aforementioned type or, respectively, for an actuating drive equipped therewith, an improved embodiment which is in particular characterized in that it is compact and/or allows a simplified assembly.

This problem is solved according to the invention by the subject matters of the independent claims. Advantageous embodiments are subject matter of the dependent claims.

The invention is based on the general idea to configure for an actuator, the electric motor of which can be inserted through an insertion opening into a housing, a cover for closing the insertion opening as screw cover which has a cup-shaped section comprising a cylindrical wall and a bottom, and which is adjusted in such a manner that the electric motor rests axially on the bottom of the cover when the cover is screwed on. In this manner, an axial preload or bracing of the electric motor can be implemented with the cover. In particular, manufacturing tolerances can be compensated in this manner to allow a play-free positioning of the electric motor in the housing.

In an advantageous embodiment, between the cup-shaped section and a threaded section, the cover can comprise a transition section which is configured as axial tension spring. This transition section is tensioned during tightening the screwable cover, whereby an axial preload force can be applied to the electric motor. At the same time, the resilient transition region allows thermally related relative movements between the electric motor and the housing with cover. Such relative movements can occur during the operation of the actuator due to different thermal expansion coefficients of the electric motor, on the one hand, and the housing as well as the cover, on the other. Since the resilient transition region allows such relative movements and, at the same time, ensures a sufficient axial preload at all times, thermal stress peaks within the actuator can be prevented which supports the durability of the actuator even in an environment with frequently changing temperatures.

Moreover, a cup-shaped trough can be centrally incorporated at the bottom of the cup-shaped section, into which trough a cylindrical projection of the electric motor can project. Said cylindrical projection can involve, for example, a bearing for a drive shaft of the electric motor. The trough integrated in the bottom of the cover thus allows a positioning of the mentioned projection, thus, in particular, of a shaft bearing. This is in particular advantageous for achieving an increased durability in case of high forces or torques.

Further important features and advantages arise from the sub-claims, from the drawings, and from the associated description of the figures based on the drawings.

It is to be understood that the above mentioned features and the features yet to be explained hereinafter can be used not only in the respectively mentioned combination but also in other combinations or alone without departing from the scope of the present invention.

BRIEF DESCRIPTION OF THE DRAWING

Preferred exemplary embodiments of the invention are illustrated in the drawings and are explained in the following description in more detail, wherein identical reference numbers refer to identical, or similar, or functionally identical components.

In the figures, schematically.

DETAILED DESCRIPTION

Figure 1:
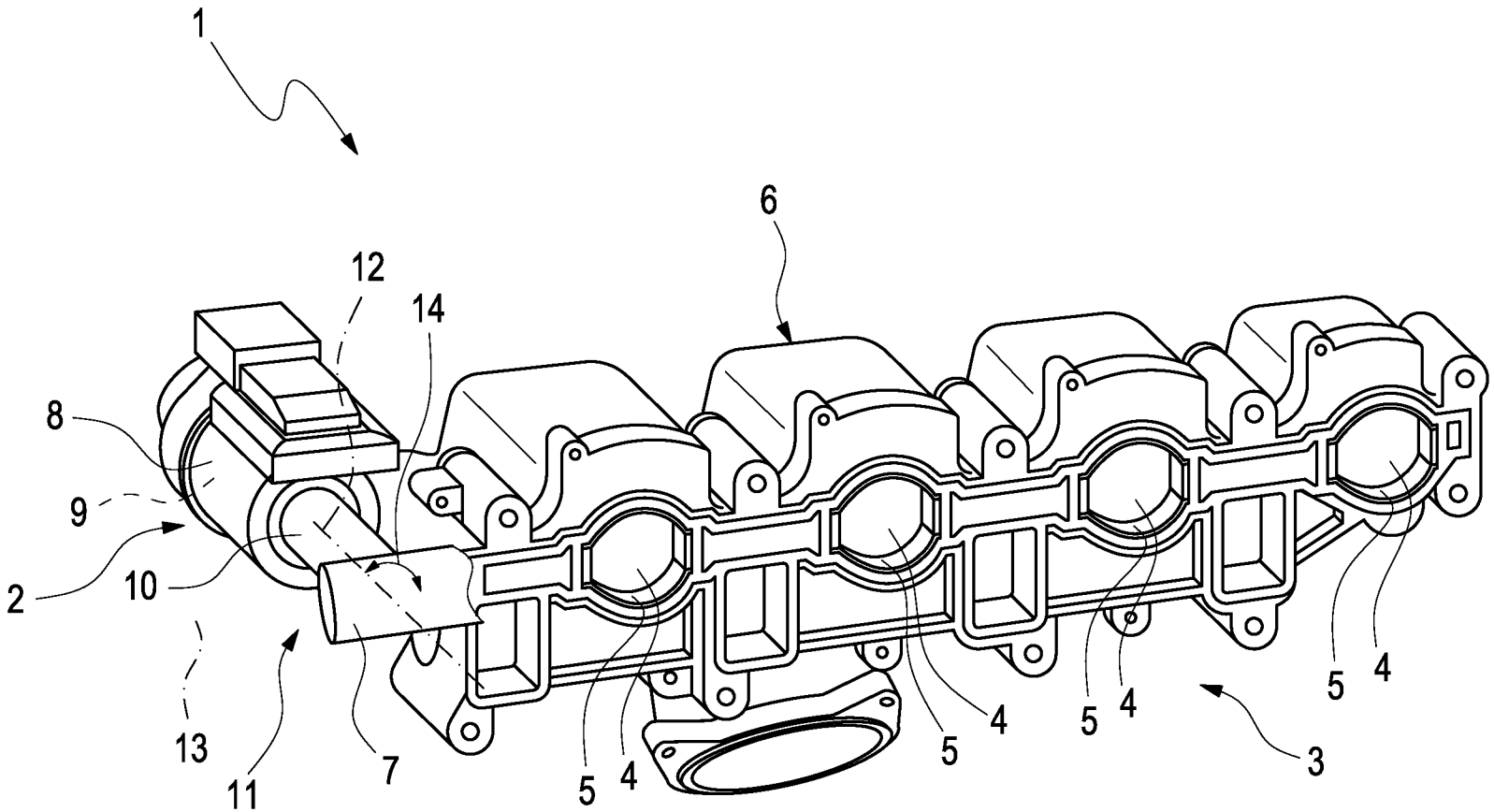
FIG. 1 shows a perspective view of an adjusting element.

According to FIG. 1, an adjusting element 1 which can be, in particular, permanently mounted in a motor vehicle comprises an actuator 2 and an actuating member arrangement 3. In the example, the actuating member arrangement 3 has a plurality of actuating members 4, here four of them, which are exemplary configured as flaps. Here, the respective member 4, thus the respective flap 4, serves for controlling a cross-section through which a flow can pass in a line 5 through which a flow can pass, preferably in a vehicle. For example, the adjusting element 1 is arranged in a fresh gas duct of an internal combustion engine of a vehicle and can be configured there as tumble flap and/or swirl flap. In the example, the adjusting element 1 is integrated in an intake module 6 by means of which fresh gas is distributed to the individual combustion chambers of an internal combustion engine. It is principally also possible to use the adjusting element 1, e.g., for a fuel cell system, for example, for controlling the anode gas or the cathode gas or the exhaust gas.

The adjusting element 1 comprises an actuating shaft 7 by means of which the actuating members 4 can be actuated. Here, the actuating shaft 7 can be rotatably driven about its longitudinal center axis while the actuating members 4 are more or less connected in a rotationally fixed manner to the actuating shaft 7.

The actuator 2 has a housing 8 in which an electric motor 9 is arranged. With the electric motor 9, a driven shaft 10 of the actuator 2 can be rotatably driven. The driven shaft 10 rotates about its longitudinal center axis. For torque transmission between the driven shaft 10 and the actuating shaft 7, a bevel gear drive 11 is provided. The driven shaft 10 and the actuating shaft 7 are oriented relative to one another in such a manner that between a rotation axis 12 of the driven shaft 10 and a rotation axis 13 of the actuating shaft 7 an angle 14 exists which lies in a range of 60° to 120°, inclusively, and which lies in the shown preferred exemplary embodiment at approximately 90°.

Figure 10:
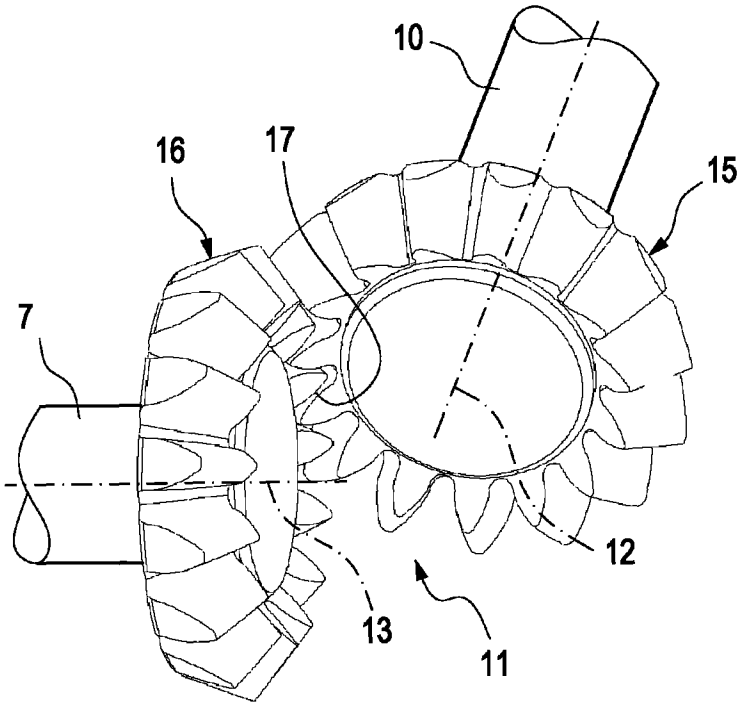
FIG. 10 shows a perspective view of a bevel gear drive.
Figure 14:
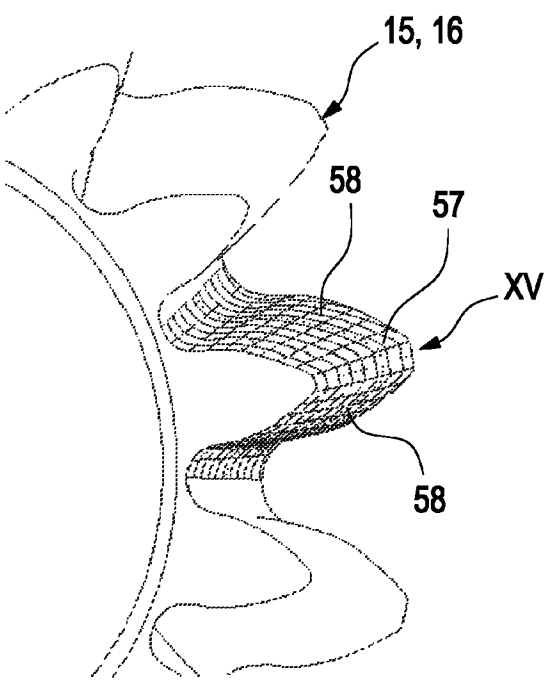
FIG. 14 shows an enlarged cut-out XIV of the bevel gear of FIG. 13.

According to FIG. 10, the bevel gear drive 11 comprises two bevel gears, namely a first bevel gear 15 and a second bevel gear 16 which are engaged with one another in an engagement region 17 to implement the desired torque transmission between the bevel gears 15, 16. The first bevel gear 15 is fixedly connected to the driven shaft 10 and is arranged coaxially with respect to the rotation axis 12 of the driven shaft 10. In a corresponding manner, the second bevel gear 16 is connected to the actuating shaft 7 in a rotationally fixed manner and oriented coaxially to the rotation axis 13 of the actuating shaft 7. The rotationally fixed coupling between the respective bevel gear 15, 16 and the respective shaft 7, 10 can be implemented, for example, by a press fit and/or by positive locking. The bevel gears 15, 16 can also be welded and/or glued and/or screwed together with the shafts 7, 10.

According to the FIGS. 2 to 7, the electric motor 9 has a rotatably drivable drive shaft 18 which with respect to its rotation axis is advantageously oriented coaxially to the rotation axis 12 of the driven shaft 10. In its housing 8, the actuator 2 contains a planetary gear drive 19. Via said planetary gear drive 19, the drive shaft 18 is drivingly connected with the driven shaft 10. The planetary gear drive 19 has at least one gear stage 20 or 21. In the example, exactly two such gear stages 20, 21 are provided. It is obvious that in other embodiments only one, or three, or more such gear stages 20, 21 can be provided.

Each gear stage 20, 21 has a sun gear 22 or 23 as well as at least two planet gears 24. In the example, each gear stage 20, 21 has three planet gears 24. The respective sun gear 22, 23 is in engagement with the associated planet gears 24. The planet gears 24 are each rotatably mounted on a planet gear carrier 25 and are also in engagement with an annulus gear 26. Here, for both gear stages 20, 21, a common annulus gear 26 is provided with which all planet gears 24 of the two gear stages 20, 21 are in engagement. With exactly two gear stages 20, 21, one of them is a drive-side gear stage 20 while the other one is a driven-side gear stage 21. With three or more gear stages 20, 21, between the drive-side and the driven-side gear stages, at least one or more intermediate stages are arranged. In the drive-side gear stage 20, the sun gear 22 is connected to the drive shaft 18 in a rotationally fixed manner. In contrast, in the driven-side gear stage 21, the planet gear carrier 25 is connected to the drive shaft 10 in a rotationally fixed manner. Between the driven shaft 10 and the respective planet gear carrier 25, an axial engagement is provided which takes place on a diameter as large as possible to be able to transmit torques as high as possible. This engagement which transmits torques can be configured, for example, as plug connection.

For the preferred embodiment introduced here, the planet gears 24 of the gear stages 20, 21 are identical parts. In addition, the planet gear carriers 25 are configured as identical parts. In the example, the respective planet gear carrier 25 is connected in each case in a rotationally fixed manner to the sun gear 23 of the next following gear stage. This is preferably implemented in that the respective sun gear 23 of the following stage is manufactured integrally with the planet gear carrier 25 of the preceding stage. Since here, the planet gear carriers 25 are identical parts, the planet gear carrier 25 of the driven-side gear stage 21 is also provided with such a sun gear 23 although it basically does not need such a sun gear 23 because the torque transmission to the drive shaft 10 is advantageously not carried out via said additional sun gear 23, but in a different manner, namely preferably on a larger diameter directly via the planet gear carrier 25.

The sun gear 22 of the input-side gear stage 20 is connected to the drive shaft 18 in a rotationally fixed manner and thus is in particular not an identical part to the sun gears 23 of the planet gear carriers 25. In contrast to this, the sun gears 23 of the gear stages following the input-side gear stage 20 can be configured again as identical parts. It is also possible to configure all sun gears 22, 23 as identical parts if they are manufactured separately from the planet gear carriers 25 and are connected during assembly in a suitable and rotationally fixed manner to the drive shaft 18 or the respective planet gear carrier 25.

Figure 3:
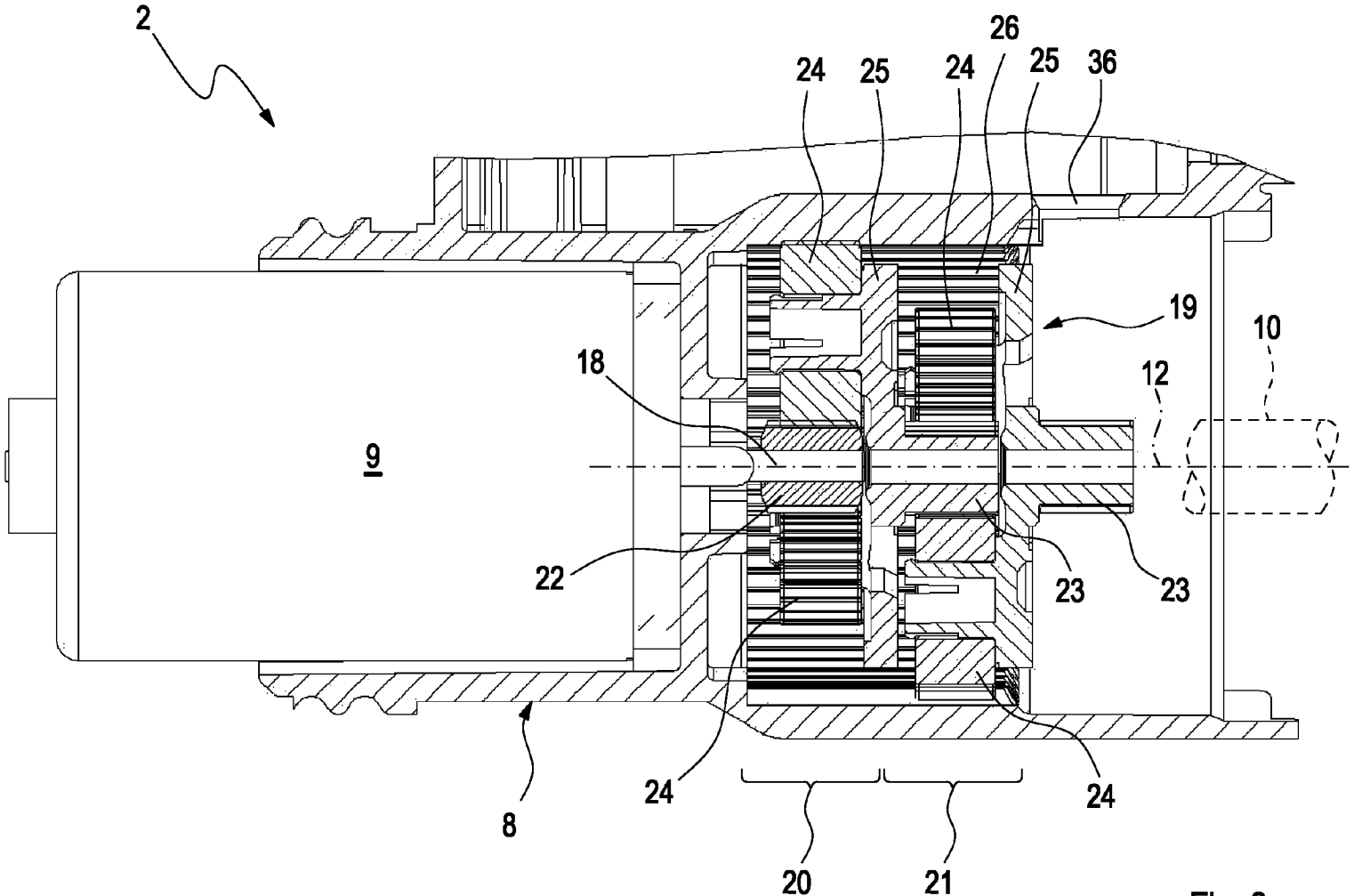
FIG. 3 shows a longitudinal section through a gear drive of the actuator.
Figure 4:
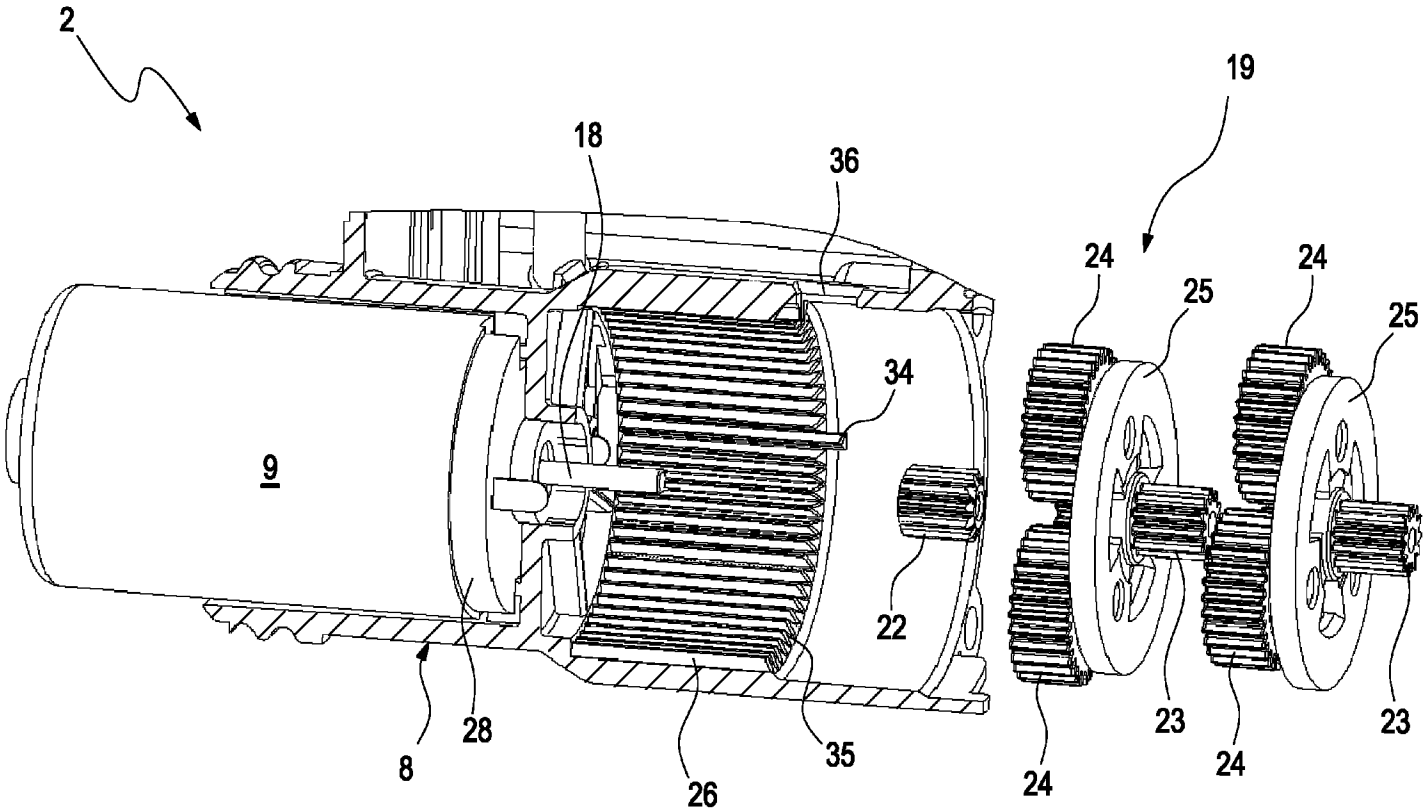
FIG. 4 shows a perspective view of the partial cross-section of the actuator in an exploded illustration.
Figure 5:
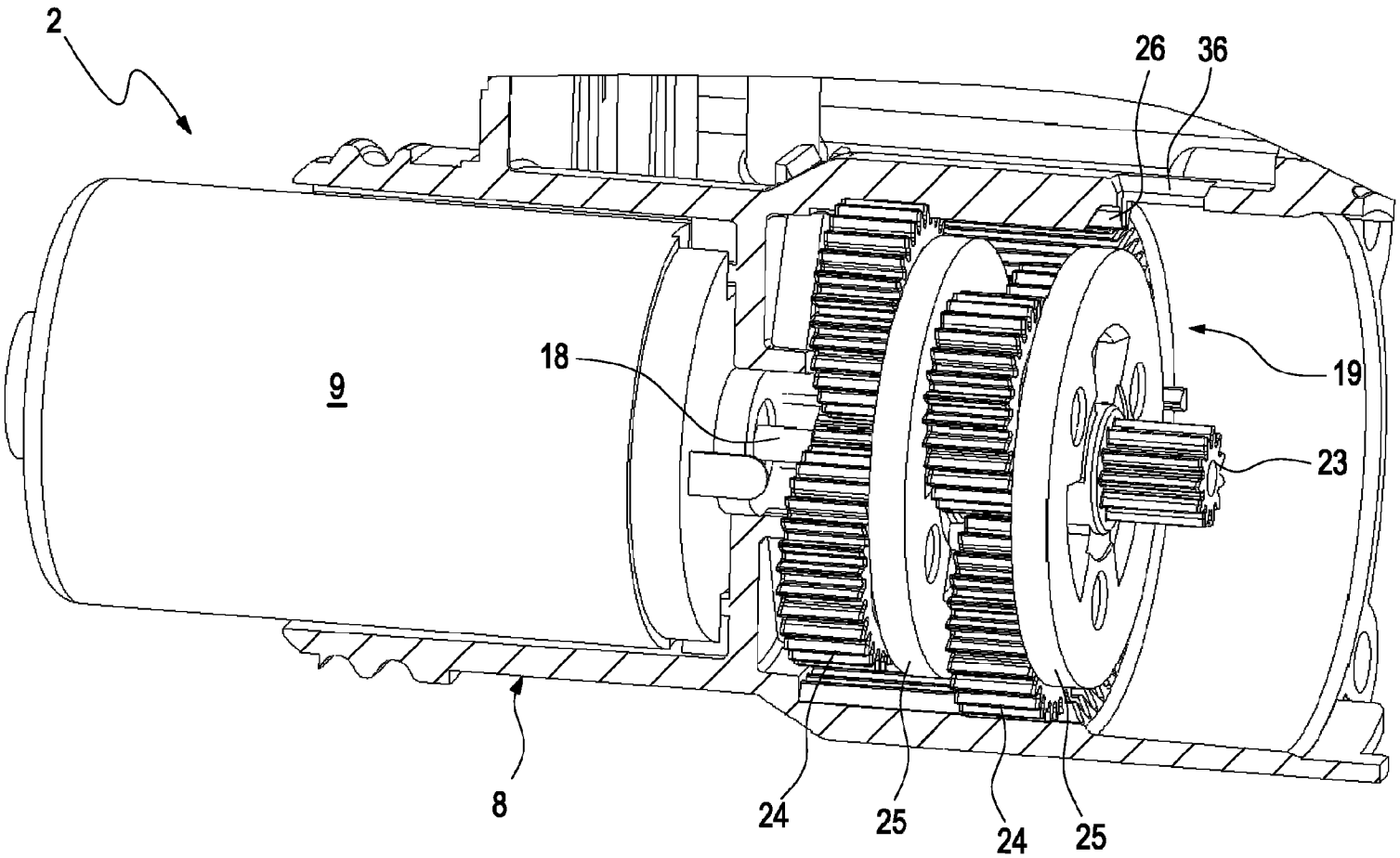
FIG. 5 shows a perspective, partial cross-sectional view of the actuator.
Figure 6:
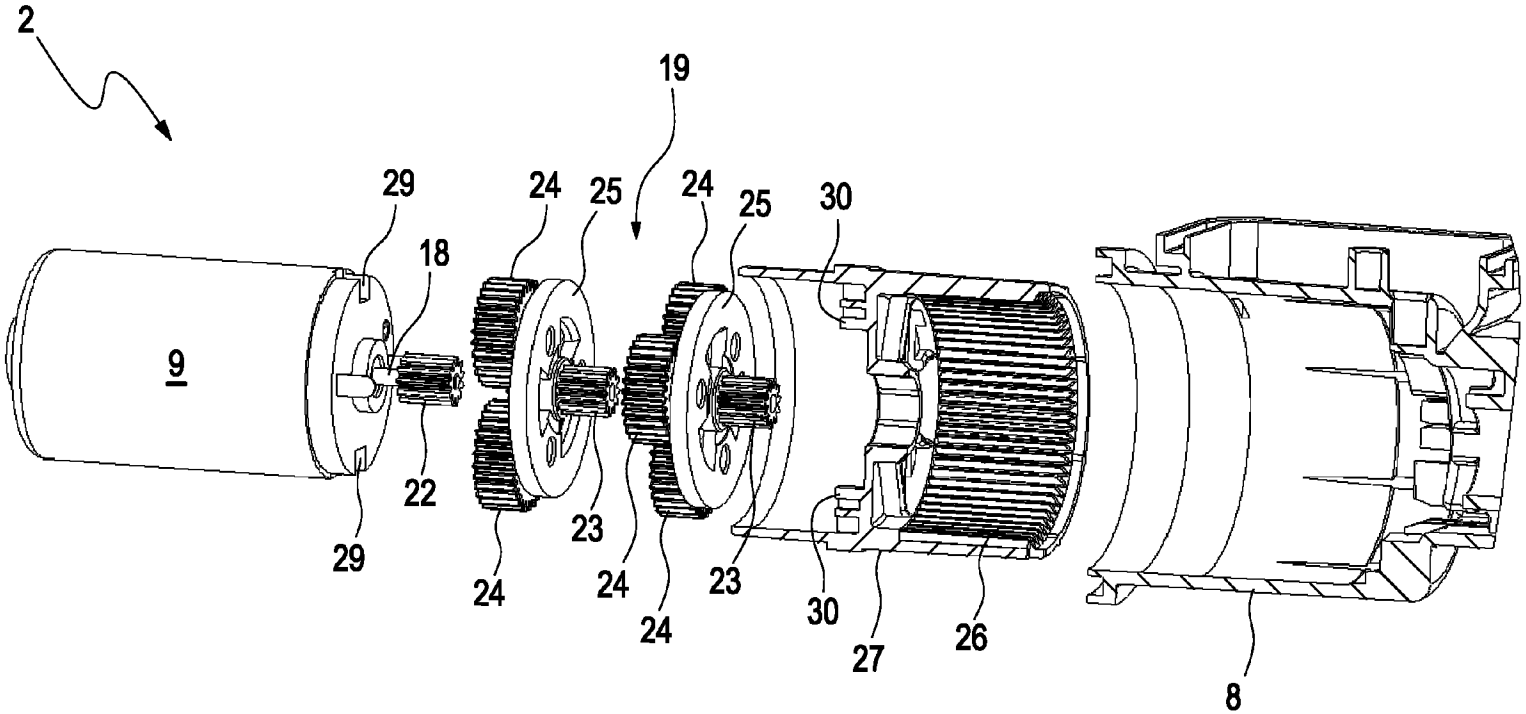
FIG. 6 shows a perspective view of the gear drive of the actuator in an exploded illustration of another embodiment.
Figure 7:
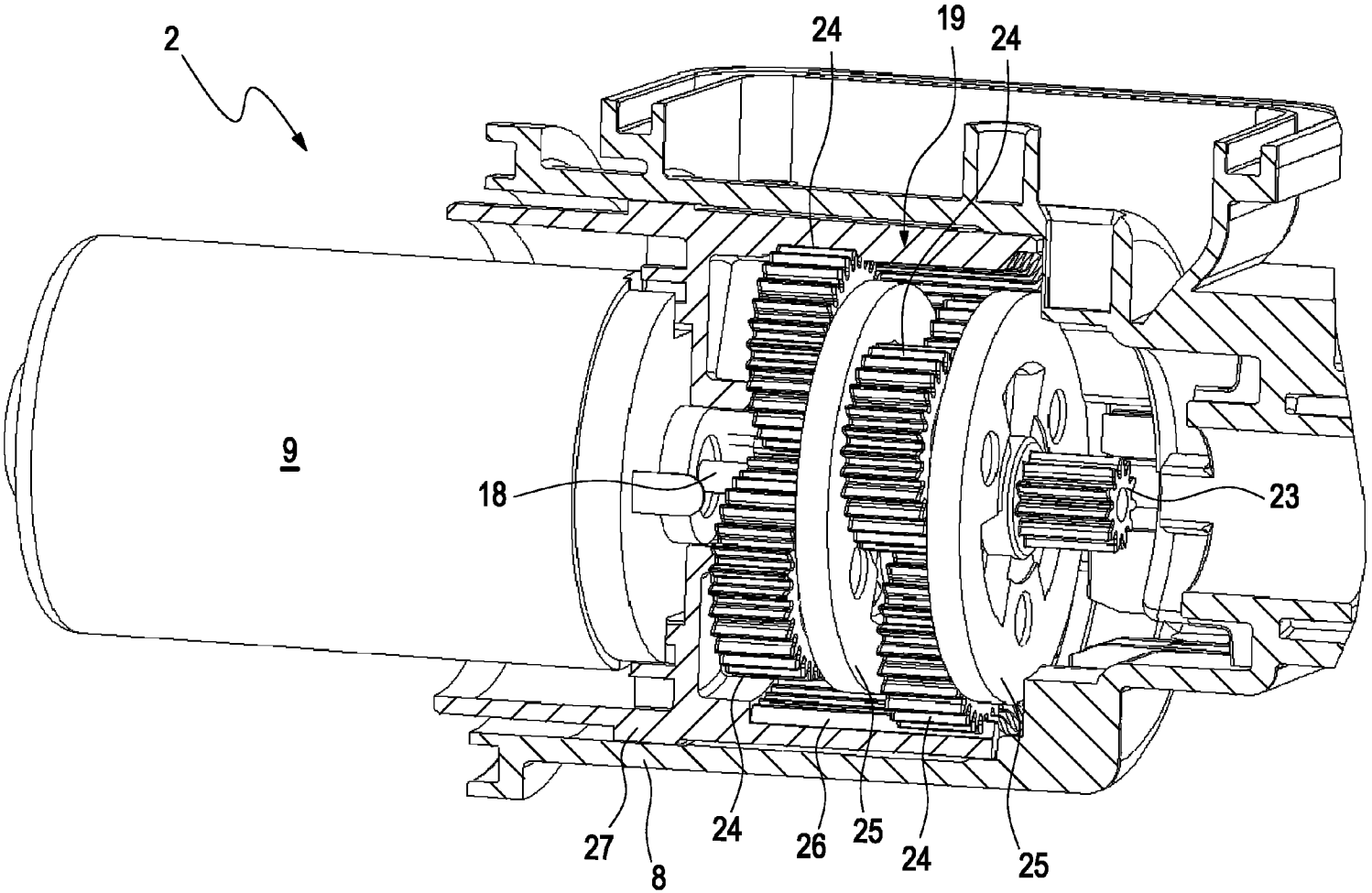
FIG. 7 shows a perspective view of the partial cross-section of the actuator of FIG. 6.

In the embodiments of the FIGS. 3 to 5, the annular gear 26 forms an integral part of the housing 8 which serves for receiving the electric motor 9. In contrast, the FIGS. 6 to 7 show an embodiment in which the annular gear 26 is formed within an insert part 27 which forms a separate component with respect to the rest of the housing 8. By using such an insert part 27, the possibility to preassemble the planetary gear drive 19 can be improved.

According to the FIGS. 4 to 7, at its front end 28 facing the planetary gear drive 19, the electric motor 9 has at least one, here two recesses 29. In the assembled state, complementary ribs 30 engage axially with said recesses 29. Said ribs 30 are integral parts of the housing 8 or insert part 27. Hereby, in the assembled state, a torque support between the electric motor 9 and the housing 8 or the insert 27 is implemented.

The housing 8 receives the electric motor 9 and the planetary gear drive 19 or, respectively, the insert part 27. According to FIG. 1, the driven shaft 10 extends out of the housing 8 and is connected outside of the housing 8 in a rotationally fixed manner to a drive member which, in the shown example, is formed by the first bevel gear 15. Basically, the drive member drivable by the drive shaft 10 can involve any drive member such as, e.g., a pinion gear, or a lever, or a gear wheel, or a coupling element, or a coupling for direct torque transmission or any combination of the aforementioned drive members.

Figure 2:
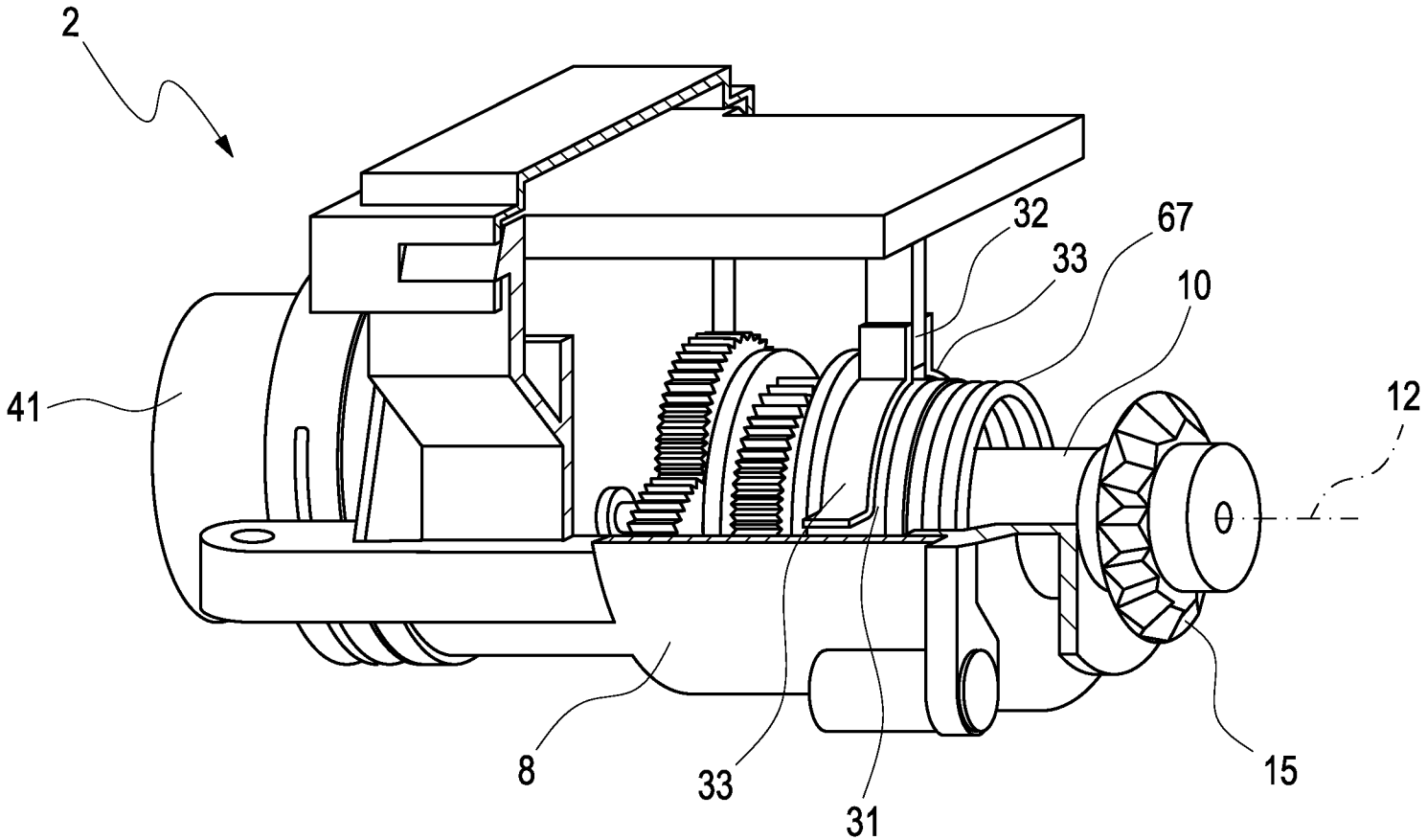
FIG. 2 shows a perspective, partial cross-sectional view of an actuator.

According to FIG. 2, one of the shafts of the actuator 2 can be equipped within the housing 8 with a signal generator 31. In the example, the driven shaft 10 is connected to the signal generator 31 in a rotationally fixed manner so that a rotation of the driven shaft 10 goes along with a rotation of the signal generator 31. Furthermore, the housing 8 contains a rotation angle sensor 32 which is configured in such a manner that it interacts with the signal generator 31 in a contactless manner. The rotation angle sensor 32 involves in particular a Hall sensor which is also designated hereinafter with 32. The Hall sensor 32 detects changes of a magnetic field. Thus, advantageously, a permanent magnet is used as signal generator 31, which permanent magnet is also designated with 31. The permanent magnet 31 is connected to the driven shaft 10 in a rotationally fixed manner and is polarized in such a manner that a rotational movement of the driven shaft 10 changes the magnetic field in the region of the Hall sensor 32. Hereby, the Hall sensor 32 can detect the rotation of the driven shaft 10.

To improve the accuracy of the rotation angle sensor 32 or the angular resolution of the rotation angle sensor 32, two conductive elements 33 are provided here. They are configured in such a manner that they redirect a magnetic field of the permanent magnet 31 at least partially to the Hall sensor 32. For example, such conductive elements 33 can be made of sheet metal. The conductive elements 33 extend starting from the Hall sensor 32 and radially spaced apart from the permanent magnet 31 and with respect to the rotational axis 12 of the driven axis 10 in the circumferential direction. For example, each conductive element 33 extends over an angle of approximately 90° so that together, they encompass the permanent magnet 31 over an angle of approximately 180°.

For axial positioning of the conductive elements 33 it can be provided according to FIGS. 4 and 5 to axially extend individual teeth 34 of a toothing 35 of the annular gear 26 at a side facing away from the electric motor 9. The respective conductive element 33 can axially abut against said axially extended tooth 34, whereby it is positioned in the housing 8 in a stable manner. Moreover, in the region of the Hall sensor 32, the housing 8 contains a through-opening 36 through which the Hall sensor 32 can project into the interior of the housing 8 and through which the Hall sensor 32 is coupled with an evaluation circuit which is not illustrated or described here in more detail.

According to FIG. 2 it can also be provided to arrange a reset spring 67 within the housing 8, which spring is supported, on the one hand, on the housing 8 and, on the other, on one of the shafts, preferred on the drive shaft 10. By the reset spring 67, the actuator 2 or its driven shaft 10 can be biased into an end position or into a starting position or neutral position lying between two end positions. Hereby, in particular, an emergency function for the respective adjusting element 1 can be implemented in the event that a power outage occurs and the electric motor 9 can not be controlled anymore.

Figure 8:
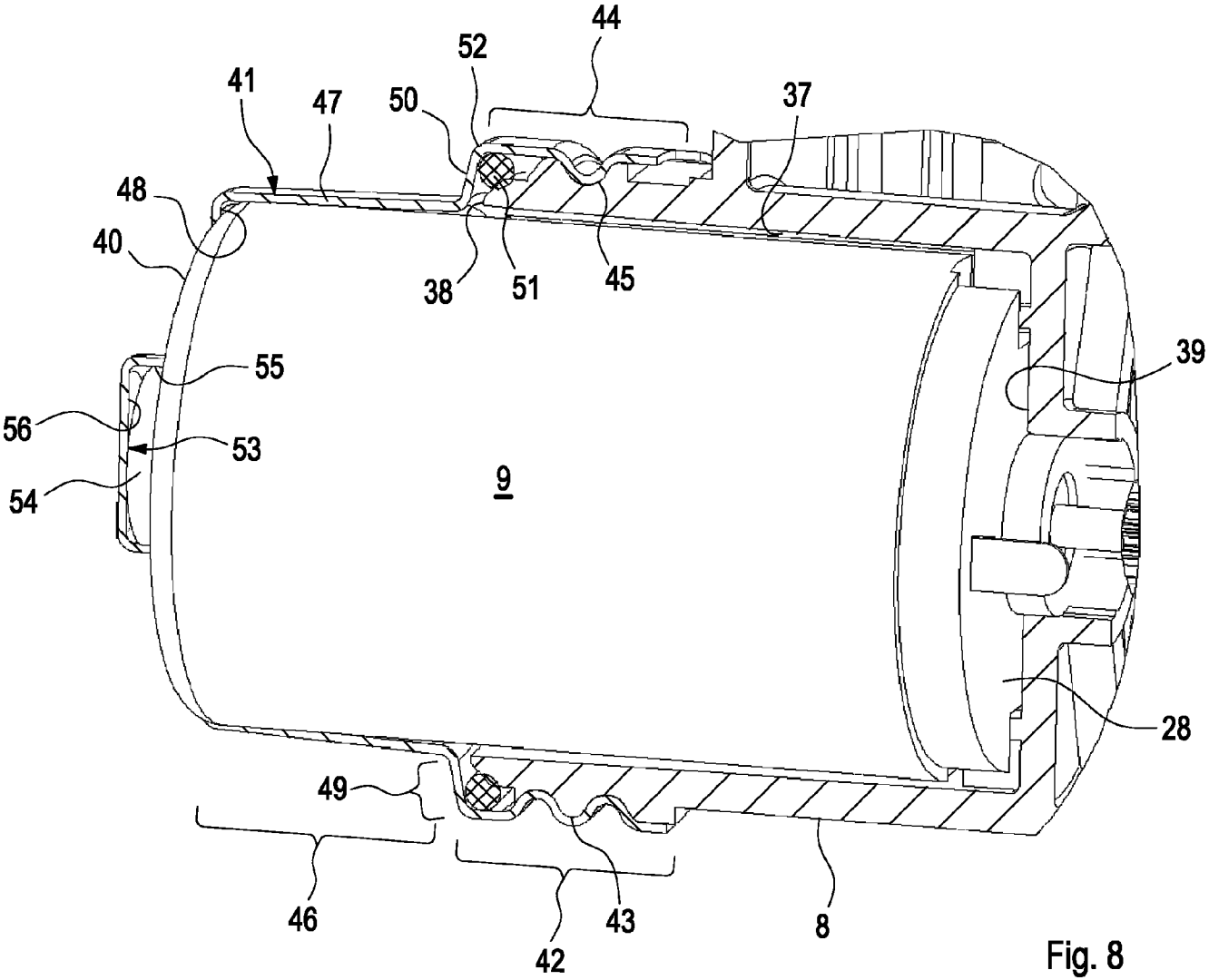
FIG. 8 shows a perspective view of the partial cross-section of the actuator in the region of an electric motor with the insertion opening closed.
Figure 9:
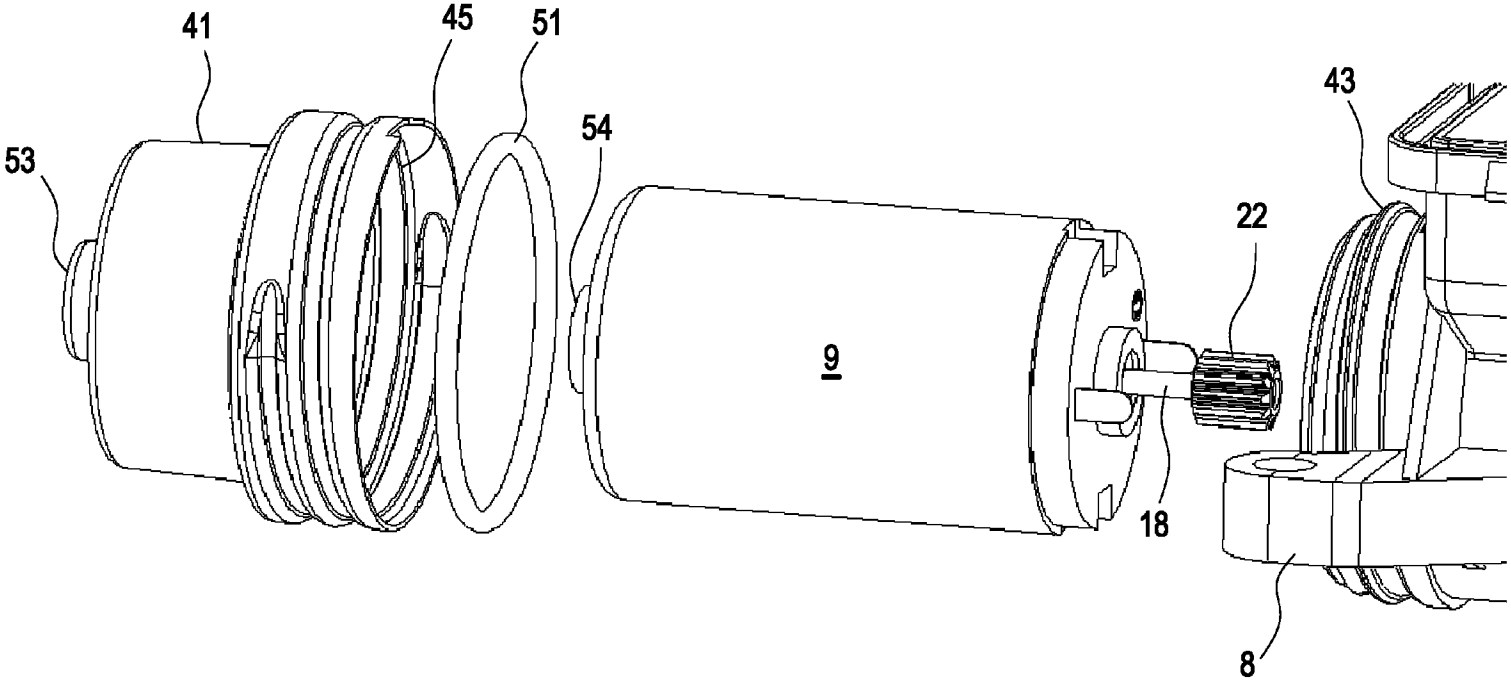
FIG. 9 shows a perspective view of the actuator of FIG. 8 in an exploded illustration.

According to the FIGS. 8 and 9, a motor receiving compartment 37 is formed for accommodating the electric motor 9 within the housing 8, which compartment is advantageously configured cylindrically and into which the electric motor 9 can be inserted through an insertion opening 38 and axially with respect to its drive shaft 18, thus coaxially to the rotational axis 12 of the driven shaft 10. In doing so, in the mounting position shown in FIG. 8, the electric motor 9 abuts axially with its front end 28 against a bottom 39 of the motor receiving compartment 37. In contrast to this, at its rear end 40 remote from or facing away from the planetary gear drive 19, the electric motor 9 projects axially out of the insertion opening 38. For closing the insertion opening 38 and for positioning the electric motor 9 within the housing 8, a cover 41 is provided which can be screwed to the housing 8. With its rear end 40, the electric motor 9 abuts axially against said cover 41.

For this, the housing 8 has a thread 43 in an insertion section 42 which includes the insertion opening 38, wherein the thread is preferably configured as external thread 43. Complementary to that, the cover 41 has a threaded section provided with a corresponding thread 45 which is preferably configured as internal thread 45. Furthermore, the cover 41 has a cup-shaped section 46 which has a cylindrical wall 47 and a bottom 48. In the assembled state, the rear end 40 of the electric motor 9 abuts axially against said bottom 48.

Moreover, the cover 41 has a transition section 49 between the cup-shaped section 46 and the threaded section 44. The transition section is configured as axial tension spring and allows an axial preload of the electric motor 9 against the bottom 39 of the motor receiving compartment 37.

In the shown preferred embodiment, the transition section 49 has an annular collar 50. The latter, on the one hand, is radially fixedly connected, here radially on the inside, to the cup-shaped section 47, and, on the other, radially fixedly connected, here radially on the outside, to the threaded section 44. In particular, the whole cover 41 is made from one piece which integrally comprises the individual sections, thus, the cup-shaped section 46, the threaded section 44, and the transition section 50.

For example, the cover 41 involves a formed sheet metal part or an injection molded part.

The transition section 50 results in an axial positioning of the cup-shaped section 46 relative to the threaded section 44. Furthermore, the transition section 50 is configured in such a manner that an axial distance of the threaded section 44 from the bottom 48 of the cup-shaped section 46 can be increased against a reset force of the transition section 49. Here, the transition section 49 acts like a spring.

Advantageously, the cover 41, housing 8 and electric motor 9 are adapted to one another in such a manner that the tension spring, which is formed by the transition section 49, is tensioned during screwing on, thus when screwing on the cover 41, thereby generating the desired axial preload of the electric motor 9 against the bottom 39 within the motor receiving compartment 37. With the cover 41 screwed on, the electric motor 9 is then braced between the bottoms 39 and 48.

For finding and fixing a desired relative rotational position between cover 41 and housing 8, a latching mechanism can be provided which is not described here in more detail. Such a latching connection comprises at least one radially projecting latching element which, when the desired relative position between housing 8 and cover 41 is reached, latches or snaps into a latching receptacle which is complementary thereto. The respective latching element can be formed as nose, ramp, rib or hemisphere or the like. The respective latching receptacle can be configured as recess, breakout, indentation or cavity or the like. Advantageously, the at least one latching element is formed on the housing 8 and projects therefrom substantially in the radial direction towards the outside. The associated latching receptacle is provided on the cover 41. As soon as the desired relative rotational position between cover 41 and housing 8 is reached, the respective latching element engages with the associated latching receptacle and secures the cover 41 against an undesired rotation so that the cover 41 can not self-actingly disengage from the housing 8. Alternatively, the latching element can be arranged on the cover 41 and can interact with the latching receptacle arranged on the housing 8.

Particularly advantageous, said latching connection can be utilized for setting a predetermined axial preload of the electric motor 9 against the bottom 39 in the motor receiving compartment 37. For this, the positioning of the latching connection can be adapted to the interacting threads 43, 45 in such a manner that the electric motor 9 reaches the desired axial preloaded exactly at the moment when the cover 41 latches via the latching connection with the housing 8. This can take place as follows:

After insertion of the electric motor 9 into the motor receiving compartment 37, the cover 41 is placed onto the housing 8 and screwed on. As soon as the electric motor 9 axially abuts, on the one side, against the bottom 39 and, on the other side, against the cover 41 without, however, already transmitting a tensile stress onto the transition section 49, a defined state exists with a predetermined relative position between the cover 41 and the housing 8. Starting from said state, the cover 41 has to be further rotated or screwed by a maximum of 90°, thus by a quarter turn, before the latching connection between cover 41 and housing 8 can snap in. Within said quarter turn, an axial distance between cover 41 and housing 8 is covered which distance depends on the thread pitch and which transmits a defined preload to the transition section 49. For example, the threads 43, 45 interacting with one another can have a pitch of 2 mm. A quarter turn thus results in an axial travel of 0.5 mm. The length tolerance between the maximum length and the minimum length of the electric motor 9 is advantageously maximum 0.5 mm, advantageously less than 0.5 mm, however. Thus, through the proposed construction, the length tolerance of the electric motor 9 can be completely covered within the mentioned quarter turn. If other length tolerances have to be compensated, other adequate thread pitches and/or other rotation ranges can be provided. An electric motor 9 with the minimal length thus has the lowest preload. In contrast, the electric motor 9 with the maximal length is fixed with the highest preload. The lowest preload force is configured such that it is sufficient for supporting and fixing the electric motor 9. The highest preload force is advantageously configured such that the electric motor 9 is not damaged.

The FIGS. 8 and 9 only indicate a latching receptacle designated with 68 which is provided here purely exemplary on the cover 41, namely in the form of an axially open cut-out which radially penetrates the cover 41 at a front end facing towards the housing 8. In the predetermined relative position between housing 8 and cover 41, a non-illustrated latching element on the housing side penetrates into said latching receptacle 68.

In the shown example, in the region of the insertion opening 38, a seal 51 is arranged between the insertion section 42 and the cover 41. Particularly advantageous is the embodiment shown here in which the seal 51 is arranged at a transition 52 between the transition section 49 and the threaded section 44. During tightening the cover 41, the seal 51 is compressed whereby the desired tightness can be achieved.

In the shown embodiments, the bottom 48 of the cup-shaped section 46 has a trough 53. The same is arranged centrally with respect to the cover 41 and is formed cup-shaped. A cylindrical projection 54 of the electric motor 9 projects into said trough 53. Said projection 54 extends axially from the rear end 40 of the electric motor 9. Said projection 54 can comprise, for example, a bearing, which is not shown here in detail, for the drive shaft 18 of the electric motor 9. Advantageously, the projection 54 and the trough 53 are adapted to one another with respect to their dimensions in such a manner that, on the one hand, a radial support of the projection 54 takes place on a wall 55 of the trough 53. On the other hand, the projection 54 is spaced apart in the axial direction from a bottom 56 of the trough 53. Accordingly, the trough 53 is only an alignment of the projection 54 with respect to the rotational axis of the drive shaft 18. The axial bracing of the electric motor 9, however, is carried out outside of the trough 53 via the bottom 48 of the cover 41.

While the cover 41 is made, for example, from a metal, the rest of the housing 8 consists preferably of a plastic. By means of the resilient transition section 49, thermally related expansions which can result in different length changes within the housing 8, the cover 41 and the electric motor 9 can be resiliently absorbed.

In addition, in the assembled state, the cover 41 assumes the function of a heat sink for the electric motor 9 to dissipate the lost energy of the electric motor 9 to the surrounding atmosphere. Here, the heat of the electric motor 9 is transmitted via the surface of its rear end 40 to the surface of the bottom 48 of the cover 41 which, e.g., is made of sheet metal. The heat thus can be dissipated to the surrounding atmosphere whereby the electric motor 9 is cooled.

Figure 15:
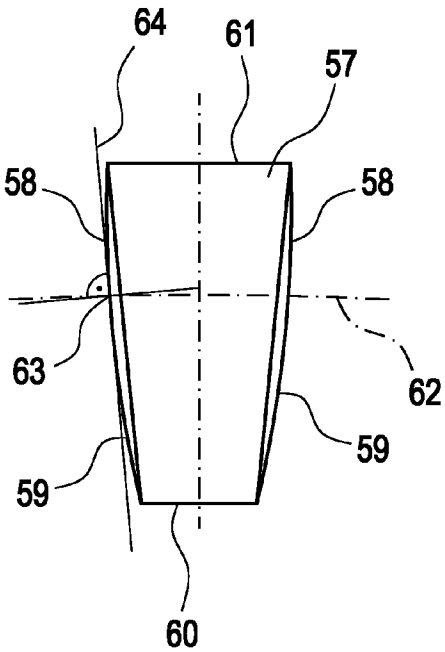
FIG. 15 shows an enlarged top view of a tooth of the bevel gear according to a viewing direction XV in FIG. 14.
Figure 13:
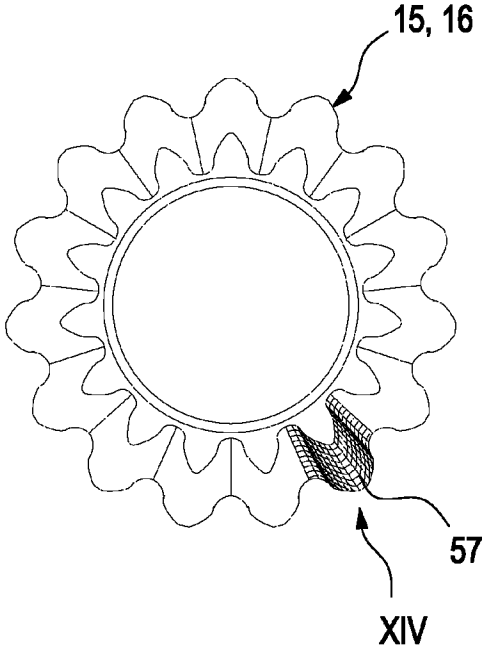
FIG. 13 shows an enlarged view of a bevel gear of the bevel gear drive.

According to the FIGS. 10 to 15, the bevel gears 15, 16 of the bevel gear drive 11 have a special toothing or tooth shape. FIG. 15 shows an individual tooth 57 of one of the bevel gears 15, 16. As can be seen, along its radial profile, said tooth 57 has an outwardly curved or convex tooth flank 58. The tooth flank 58 thus has a curvature 59 which initially increases from one axial end 60 to the other axial end 61 of the respective tooth 57 and then decreases again.

In FIG. 15, a segment of a pitch circle 62 of the respective bevel gear 15, 16 is plotted. As can be seen, the curvature 59 of the tooth flanks 58 is formed in a preferred embodiment in such a manner that, in an intersection 63 with the tooth flank 58, said pitch circle 62 stands perpendicular on a tangent 64 which touches the tooth flank 58 in the intersection 63.

Figure 11:
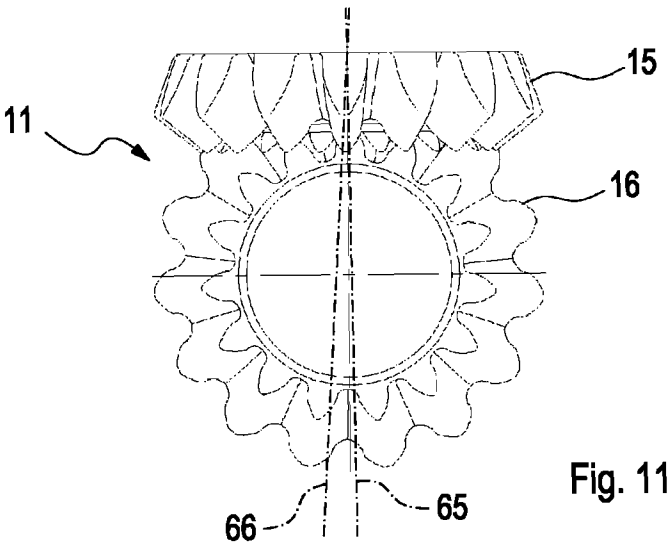
FIG. 11 shows a top view of the bevel gear drive.
Figure 12:
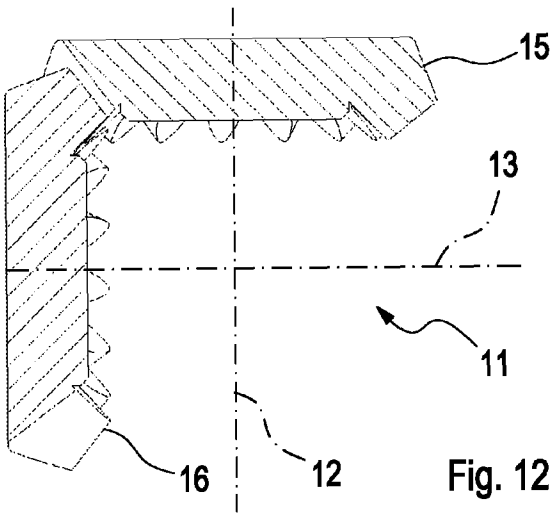
FIG. 12 shows a sectional view of the bevel gear drive.

The proposed curved or convex tooth flank geometry of the bevel gears 15 results in a point contact in the engagement region 17 via the tooth flanks 58. The selected shape for the tooth flanks 58 can compensate position deviations between the rotational axes 12 and 13 of the driven shaft 10 and the actuating shaft 7. For example, the bevel gears 15, 16 are configured for an angle 14 between the rotational axes 12, 13 which is, for example, 90°. The design of the bevel gears 15, 16 defines a target state here. However, due to assembly tolerances, after the assembly of the actuator 2 or the adjusting element 1, an actual situation arises which usually deviates from the target specification. Thus, in the assembled state, the rotational axes 12, 13 of the driven shaft 10 and the actuating shaft 7 can enclose an angle 14 which deviates from 90°. Furthermore, it might well be the case that the two rotational axes 12, 13 do not intersect, which also results in a positional deviation of the bevel gears 15, 16 which are fixedly connected to the shafts 10, 7. In FIG. 11, positional deviations of the one rotational axis 12, 13 are exemplary illustrated with dotdashed lines which deviations are still tolerable for the toothing of the bevel gear drive 11 proposed herein. The one line 65 defines, for example, a target orientation of the one rotational axis, while the other line 66 represents an actual orientation of the respective rotational axis which is still tolerable. It is also shown that a certain eccentricity between the two rotational axes 12, 13 is tolerable.

Moreover, it is sufficient to tooth one of the two bevel gears 15, 16 in the described manner. However, it is preferred to equip both bevel gears 15, 16 with the described toothing. Preferred is an embodiment in which both bevel gears 15, 16 are configured as identical parts. The bevel gears 15, 16 can in particular be made of plastic, wherein injection molding is preferred.

The invention claimed is:

1. An actuator, comprising:

a housing; and an electric motor arranged in the housing, wherein the housing has an insertion opening with a cylindrical motor receiving compartment through which the electric motor is axially inserted, wherein the electric motor axially rests on a bottom of the motor receiving compartment on a first side and axially projects from the insertion opening on an opposite side, wherein the electric motor rests axially on a cover that is screwed to the housing for closing the insertion opening, wherein the housing is threaded in an axial insertion section of the insertion opening, wherein the cover has a threaded section complementary to the thread of the housing, and wherein the cover has a cup-shaped section with a cylindrical wall and a bottom on which the electric motor rests axially.

2. The actuator according to claim 1, wherein the cover has a transition section configured as an axial tension spring between the cup-shaped section and the threaded section.

3. The actuator according to claim 2, wherein the cover, housing, and electric motor are adapted to one another such that screwing on the cover tensions the tension spring formed by the transition section, thereby axially preloading the electric motor.

4. The actuator according to claim 2, wherein the transition section has an annular collar which is radially fixedly connected to the cup-shaped section on the first side and radially fixedly connected to the threaded section on the opposite side.

5. The actuator according to claim 2, wherein the transition section axially positions the cup-shaped section relative to the threaded section, wherein an axial distance of the threaded section from the bottom of the cup-shaped section is increased against a reset force of the resilient transition section.

6. The actuator according to claim 1, wherein at least one seal is arranged in the region of the insertion opening, between the insertion section and the cover.

7. The actuator according to claim 6, wherein the seal is arranged at a transition between the transition section and the threaded section.

8. The actuator according to claim 1, wherein the bottom of the cover is configured such that the electric motor rests flatly thereon, such, that the cover at least one of works and acts as a heat conductive element dissipating heat from the electric motor.

9. The actuator according to claim 1, wherein a cylindrical projection of the electric motor projects into a central cup-shaped trough in the bottom of the cup-shaped section.

10. The actuator according to claim 9, wherein the projection at least one of comprises a bearing for a drive shaft of the electric motor, is radially supported on a wall of the trough, and is axially spaced apart from a bottom of the trough.

11. The actuator according to claim 1, wherein the housing is made of plastic while the cover is made of metal.

12. The actuator according to claim 1, wherein the actuator is an integral part of an adjusting element of a vehicle, which adjusting element has at least one actuating member which can be driven with the actuator.

13. The actuator according to claim 12, wherein the adjusting element is a flap actuator device, the at least one actuating member of which is in each case a flap for controlling a cross-section of a line through which a flow can pass.

14. The actuator according to claim 13, wherein the respective flap is at least one of a tumble flap, a swirl flap and a throttle flap in at least one of a fresh gas duct and in an exhaust gas duct of an internal combustion engine of the vehicle.

15. An adjusting element for adjusting at least one actuating member comprising:

an actuator having a housing having a cylindrical motor receiving compartment insertion opening having a partially threaded axial insertion section; and an electric motor axially inserted into and axially resting on a bottom of the receiving compartment on a first side and axially projecting from the insertion opening on an opposite side, wherein the electric motor, on the first side, rests axially on a cover having a cup-shaped section with a cylindrical wall and bottom on which the motor's first side rests axially, the cover has threads that correspond to the housing for threadingly engaging the cover to the housing to close the insertion opening.

16. The actuator according to claim 15, wherein the cover, housing, and electric motor are adapted to one another such that screwing on the cover tensions a transition section configured as an axial spring between the cup-shaped section and the threaded section, thereby axially preloading the electric motor.

17. The actuator according to claim 16, wherein the transition section has an annular collar, which is radially fixedly connected to the cup-shaped section on the first side and radially fixedly connected to the threaded section on the opposite side.

18. The actuator according to claim 16, wherein the transition section axially positions the cup-shaped section relative to the threaded section, wherein an axial distance of the threaded section from the bottom of the cup-shaped section is increased against a reset force of the resilient transition section.

19. The actuator according to claim 15, wherein at least one seal is arranged in the region of the insertion opening, between the insertion section and the cover, and at a transition between the transition section and the threaded section.

20. The actuator according to claim 15, wherein the bottom of the cover is configured such that the electric motor rests flatly thereon, such, that the cover at least one of works and acts as a heat conductive element dissipating heat from the electric motor.

* * * * *